US010150202B2

(12) United States Patent
Jiang et al.

(10) Patent No.: US 10,150,202 B2
(45) Date of Patent: Dec. 11, 2018

(54) SMALL AUTOMATIC POLISHING LIQUID CLEANING DEVICE FOR RIGID GAS PERMEABLE CONTACT LENS

(75) Inventors: Jun Jiang, Zhejiang (CN); Hao Chen, Zhejiang (CN); Ying Shi, Zhejiang (CN); Atsuhiro Doke, Zhejiang (JP); Zhaolin Xia, Zhejiang (CN)

(73) Assignees: WENZHOU FOCUSEE VISION CARE TECHNOLOGIES CO., LTD., Zhejiang (CN); WENZHOU MEDICAL UNIVERISTY, Zhejiang (CN); MENICON CO., LTD., Aichi (JP)

( * ) Notice: Subject to any disclaimer, the term of this patent is extended or adjusted under 35 U.S.C. 154(b) by 825 days.

(21) Appl. No.: 14/130,139

(22) PCT Filed: Jul. 22, 2011

(86) PCT No.: PCT/CN2011/077518
§ 371 (c)(1),
(2), (4) Date: Dec. 30, 2013

(87) PCT Pub. No.: WO2013/013373
PCT Pub. Date: Jan. 31, 2013

(65) Prior Publication Data
US 2014/0130913 A1 May 15, 2014

(51) Int. Cl.
*B24B 57/00* (2006.01)

(52) U.S. Cl.
CPC ..... *B24B 57/00* (2013.01); *Y10T 137/86083* (2015.04)

(58) Field of Classification Search
CPC ..... Y10T 137/86083; B24B 57/00
(Continued)

(56) References Cited

U.S. PATENT DOCUMENTS 5,443,801 A * 8/1995 Langford ..... A61B 1/00059 134/137
6,880,565 B2 * 4/2005 Ouyoung ..... E03C 1/0408 137/100

(Continued)

FOREIGN PATENT DOCUMENTS

CN 1634682 A 7/2005
CN 101143275 A 3/2008

(Continued)

OTHER PUBLICATIONS

International Search Report for corresponding International Application No. PCT/CN2011/077518, dated May 3, 2012 (5 pages).

*Primary Examiner* — Rita P Adhlakha
(74) *Attorney, Agent, or Firm* — Christensen, Fonder, Dardi & Herbert PLLC

(57) ABSTRACT

A small automatic polishing liquid cleaning device for rigid gas permeable contact lens includes a container; a containing chamber is provided inside the container; an exhaust pipe, and a liquid suction pipe, which communicates with the containing chamber disposed on the container; an outlet end of the exhaust pipe communicates with a vacuum orifice of a vacuum generator via a connector, a gas inlet of the vacuum generator communicates with a pipeline for a compressed gas, and a liquid inlet of the liquid suction pipe is disposed at the bottom of a waste liquid trough.

18 Claims, 1 Drawing Sheet

(58) Field of Classification Search
USPC ..... 137/565.23
See application file for complete search history.

(56) References Cited

U.S. PATENT DOCUMENTS

| | | | | |
|---|---|---|---|---|
| 7,451,779 | B2 * | 11/2008 | Casimiro | F16M 13/02 137/343 |
| 2006/0079157 | A1 | 4/2006 | Van Brug et al. | |
| 2007/0095937 | A1 * | 5/2007 | Noguchi | B01F 3/0446 239/290 |

FOREIGN PATENT DOCUMENTS

| | | | | |
|---|---|---|---|---|
| EP | 1298370 | A1 * | 4/2003 | F01P 11/0247 |
| JP | 1-222861 | A | 9/1989 | |
| JP | 2000-109793 | A | 4/2000 | |
| JP | 2003-285267 | A | 10/2003 | |
| JP | 2003-309093 | A | 10/2003 | |

* cited by examiner

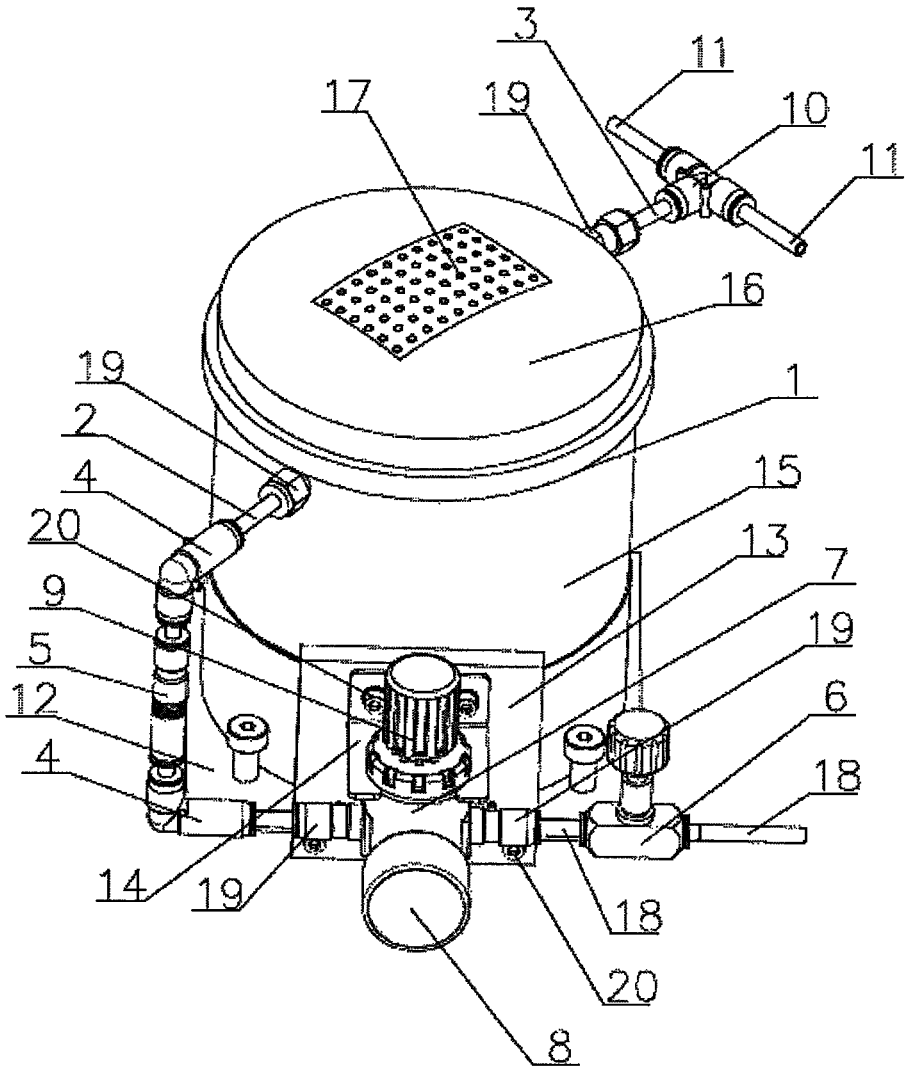
3
11
17
19
10
11
16
19
1
2
4
15
20
13
7
9
19
5
6
12
4
18
14
19
18
20
8

SMALL AUTOMATIC POLISHING LIQUID CLEANING DEVICE FOR RIGID GAS PERMEABLE CONTACT LENS

CROSS REFERENCE TO RELATED APPLICATIONS

This is a national stage application based on PCT/CN2011/077518, filed on Jul. 22, 2011. This application claims the priority of this prior application and incorporates its disclosure by reference in its entirety.

FIELD OF THE INVENTION

The present invention relates to a waste liquid cleaning device, and in particular, to a small automatic polishing liquid cleaning device for a rigid gas permeable contact lens.

BACKGROUND OF THE INVENTION

A rigid gas permeable contact lens (RGP lens) is one of the most effective refractive error correction methods and appliances accepted by international optometry and ophthalmology academia and industry at present. With the further development and popularization of the RGP lens, production, polishing and detection equipment related thereof are continuously updated and improved.

The polishing device for rigid gas permeable contact lens employed at present is provided with a waste liquid trough for storing waste liquid after polishing. Since the volume of the waste liquid trough for holding the waste liquid is limited, the waste liquid cannot be discharged automatically and timely. Once the acceptable volume limit is exceeded, the waste liquid accumulated in the waste liquid trough will overflow, which is not conducive to maintenance of a clean production environment, and the production efficiency is greatly reduced as the waste liquid needs to be cleaned frequently during the production process.

SUMMARY OF THE INVENTION

To overcome the defects in the prior art technology, this invention provides a small automatic polishing liquid cleaning device for rigid gas permeable contact lens, which solves the problem that the polishing device for rigid gas permeable contact lens cannot automatically discharge waste liquid and that the waste liquid accumulated in the waste liquid trough is prone to overflow which is not conducive to maintenance of clean environment, and avoids the necessity to frequently clean the waste liquid during a polishing process, thus effectively improving the production efficiency.

The technical solution of this invention is as follows: a small automatic polishing liquid cleaning device for rigid gas permeable contact lens comprises a container; the container is internally provided with a containing chamber; an exhaust pipe and a liquid suction pipe communicating with the containing chamber are disposed on the container; the outlet end of the exhaust pipe communicates with a vacuum orifice of a vacuum generator via a connector, the gas inlet of the vacuum generator communicates with a pipeline for a compressed gas, and the liquid inlet of the liquid suction pipe is disposed at the bottom of a waste liquid trough.

The gas inlet of the vacuum generator communicates with the pipeline for the compressed gas via an gas flow control switch.

The gas inlet of the vacuum generator communicates with the pipeline for the compressed gas via a pressure reducing valve; and the pressure reducing valve is provided with a pressure gage and a pressure adjusting knob, wherein the pressure gage communicates with an internal channel.

The pressure reducing valve and the gas flow control switch are disposed between the gas inlet of the vacuum generator and the pipeline for the compressed gas; one end of the pressure reducing valve is connected with the vacuum generator and the other end is connected with the gas flow control switch; the gas flow control switch communicates with the pipeline for the compressed gas; the pressure reducing valve is provided with the pressure gage and the pressure adjusting knob, wherein the pressure gage communicates with the internal channel.

The liquid inlet and a liquid outlet of the liquid suction pipe are connected via a tap, and the tap is provided with at least two interfaces.

The bottom part of the container is provided with a base; the lateral part of the base is provided with a bracket; a supporting plate is fixed on the bracket; and the pressure reducing valve is disposed on the bracket via the supporting plate.

The container comprises a container body and a container cover; and the container body is connected with the container cover in a dismountable way.

The upper surface of the container cover is provided with a non-slip film.

The inner wall of the container body is provided with a seal ring.

Compared with the prior art, the small automatic polishing liquid cleaning device for rigid gas permeable contact lens has the beneficial effects as follows: since a completely new waste liquid processing device is employed, the waste liquid in the waste liquid trough can be sucked timely and quickly by disposing the liquid suction pipe of the device in the waste liquid trough on a polishing machine; therefore, undesirable impacts on the environment caused by overflowing of the waste liquid accumulated in the waste liquid trough can be effectively prevented. The device is simple and safe to use and easy to control, and can improve the production efficiency of the rigid gas permeable contact lens via automatic cleaning of polishing liquid.

DESCRIPTIONS OF THE DRAWINGS

FIG. 1 illustrates a structure diagram of the present invention.

In FIG. 1, 1 refers to container, 2 refers to exhaust pipe, 3 refers to liquid suction pipe, 4 refers to connector, 5 refers to vacuum generator, 6 refers to gas flow control switch, 7 refers to pressure reducing valve, 8 refers to pressure gage, 9 refers to pressure adjusting knob, 10 refers to tab, 11 refers to interface, 12 refers to base, 13 refers to bracket, 14 refers to supporting plate, 15 refers to container body, 16 refers to container cover, 17 refers to non-slip film, 18 refers to leather pipe, 19 refers to connecting piece, and 20 refers to bolt.

DETAILED DESCRIPTIONS OF THE EXAMPLE EMBODIMENTS

Exemplary embodiments of the present invention will be introduced further with reference to FIG. 1.

As illustrated in FIG. 1, an small automatic polishing liquid cleaning device for rigid gas permeable contact lens comprises a container 1; the container 1 is internally provided with a containing chamber; an exhaust pipe 2 and a liquid suction pipe 3, which communicate with the containing chamber, are disposed on the container 1; both the exhaust pipe 2 and the liquid suction pipe 3 may be leather/rubber pipes; the outlet end of the exhaust pipe 2 communicates with the vacuum orifice of a vacuum generator 5 via a connector 4; the inlet end of the exhaust pipe 2 is connected with the container via a connecting piece 19; the liquid inlet of the liquid suction pipe 3 is also connected with the container via the connecting piece 19; the gas inlet of the vacuum generator 5 communicates with the pipeline for the compressed gas; and the liquid inlet of the liquid suction pipe 3 is disposed at the bottom of a waste liquid trough of the small automatic polishing liquid cleaning device for rigid gas permeable contact lens. A positive pressure gas source is utilized to generate negative pressure, and the compressed gas is sprayed through a sprayer nozzle of the vacuum generator 5 to form a jet flow at an outlet of the sprayer nozzle and generate entrainment and flowing; under the effect of entrainment, the gas in the container 1 connected with the exhaust pipe 2 is pumped and sucked constantly so that a pressure drop in the container 1 isreduced below barometric pressure to form a certain vacuum degree, such that waste polishing liquid is automatically pumped into the container from the waste liquid trough. According to the solution, since a completely new waste liquid processing device is employed, the waste liquid in the waste liquid trough can be sucked timely and quickly by disposing the liquid suction pipe 3 of the device in the waste liquid trough on a polishing machine; therefore, unbeneficial influences on the environment caused by overflowing of the waste liquid accumulated in the waste liquid trough can be effectively prevented. The device is simple and safe to use and easy to control, and can improve the production efficiency of the rigid gas permeable contact lens via automatic cleaning of polishing liquid.

As illustrated in FIG. 1, the gas inlet of the vacuum generator 5 communicates with the pipeline for the compressed gas via a gas flow control switch 6. The gas flow control switch 6 is disposed at the compressed gas inlet and is connected with the pipeline for the compressed gas via the leather pipe and the connector; and the needed gas flow is controlled via the gas flow control switch 6.

As illustrated in FIG. 1, the gas inlet of the vacuum generator 5 communicates with the pipeline for the compressed gas via a pressure reducing valve 7; and the pressure reducing valve 7 is provided with a pressure gage 8 and a pressure adjusting knob 9, wherein the pressure gage communicates with an internal channel. The pressure reducing valve 7 is disposed at the the compressed gas inlet; one end of the pressure reducing valve is connected with the pipeline for the compressed gas via the leather pipe and the connecting piece; and the other end of the pressure reducing valve is connected with the gas inlet of the vacuum generator 5 via the connecting piece 19, the leather pipe 18 and the connector; moreover, the pressure reducing valve is further provided with the pressure gage 8 used for displaying intensity of pressure and the pressure adjusting knob 9 capable of adjusting pressure according to demands As illustrated in FIG. 1, the pressure reducing valve 7 and the gas flow control switch 6 are disposed between the gas inlet of the vacuum generator 5 and the pipeline for the compressed gas; one end of the pressure reducing valve 7 is connected with the gas inlet of the vacuum generator 5 via the connecting piece 19, the leather pipe 18 and the connector 4; and the other end of the pressure reducing valve is connected with the gas flow control switch 6 via the connecting piece 19 and the leather pipe 18; the gas flow control switch 6 communicates with the pipeline for the compressed gas; the pressure reducing valve 7 is provided with the pressure gage 8 and the pressure adjusting knob 9, wherein the pressure gage communicates with the internal channel. A needed gas flow is controlled via the gas flow control switch 6, and the pressure adjusting knob 9 on the pressure reducing valve 7 is adjusted via a numerical value on the pressure gage 8 that displays the intensity of pressure. The compressed gas can be adjusted accurately according to the demands so as to meet requirements by employing the simultaneous effects of the gas flow control switch 6 and the pressure reducing valve 7.

As illustrated in FIG. 1, the liquid inlet and the liquid outlet of the liquid suction pipe 3 are connected via a tap 10, and the tap 10 is provided with at least two interfaces 11. One interface 11 is disposed on the liquid suction pipe; a plurality of interfaces 11 can be arranged; different interfaces 11 can be disposed according to demands in case of a plurality of rigid gas permeable contact lens polishing machines so as to clean the plurality of polishing machines simultaneously, thus effectively improving the cost and implementing rational resource utilization.

As illustrated in FIG. 1, the bottom part of the container 1 is provided with a base 12; the lateral part of the base 12 is provided with a bracket 13; a supporting plate 14 is fixed on the bracket 13; and the pressure reducing valve 7 is disposed on the bracket 13 via the supporting plate 14. Both the base 12 and the bracket 13 arranged are hard plastic; the bracket 13 is fixed on the lateral surface of the base 12 via bolts; the supporting plate 14 is fixed on the bracket 13 via the bolts; and the pressure reducing valve 7 is fixed on the supporting plate 14.

As illustrated in FIG. 1, the container 1 comprises a container body 15 and a container cover 16; the container body 15 is connected with the container cover 16 in a dismountable way; the container employs a pressure cooker type and is composed of the container body 15 and the container cover 16; when a volume of waste liquid in the container reaches a volume necessary for processing, the container cover 16 can be opened to clear up the waste liquid in the container body 15, and then the container cover 16 can be covered for use in next time. The upper surface of the container cover 16 is provided with a non-slip film 17. To ensure safety, a fastening belt needs to be tied on the outside of the container 1; in order to prevent the fastening belt from slipping, the non-slip film 17 is thus added on the container cover 16, thus improving the safety. The inner wall of the container body 15 is provided with a seal ring so as to prevent gas leakage as well as prevent the waste liquid in the container from splashing out.

The above-described embodiments shall not be considered as a limitation to the present invention. However, any improvement made based on the spirit of the present invention shall fall within the protection scope of the present invention.

What is claimed is:

1. An automatic waste-liquid container system for use with a polishing device for rigid gas permeable contact lenses, comprising:

a container defining an internal containing chamber;

an exhaust pipe communicating with the containing chamber, the exhaust pipe including an inlet end and an outlet end, the inlet end connected to the container; and a liquid suction pipe communicating with the containing chamber and connected to the container, the liquid suction pipe configured to transport liquid received from a waste liquid trough to the containing chamber of the container;

a compressed gas flow-control assembly configured to receive a compressed gas and to control a flow of the compressed gas;

a vacuum generator having an inlet end and a suction orifice, the inlet end of the vacuum generator connected to the compressed gas flow-control assembly, the suction orifice in communication with the outlet end of the exhaust pipe; and wherein the vacuum generator is configured to receive the compressed gas from the compressed gas flow-control assembly to generate a suction on the exhaust pipe via the suction orifice, thereby generating a suction pressure in the containing chamber and causing the liquid to flow into the containing chamber from the waste liquid trough.

2. The automatic waste-liquid container system of claim 1, wherein the compressed gas flow-control assembly includes a gas flow control switch.

3. The automatic waste-liquid container system of claim 2, further comprising a tap connected to the liquid suction pipe, the tap having at least two interfaces for communication with one or more waste liquid troughs.

4. The automatic waste-liquid container system of claim 2, wherein a bottom part of the container is provided with a base; a lateral part of the base is provided with a bracket; a supporting plate is fixed on the bracket; and a pressure reducing valve is disposed on the bracket via the supporting plate.

5. The automatic waste-liquid container system of claim 2, wherein the container comprises a container body and a container cover; and the container body is connected with the container cover in a dismountable way.

6. The automatic waste-liquid container system of claim 1, wherein the compressed gas flow-control assembly includes a pressure reducing valve; and the pressure reducing valve is provided with a pressure gauge and a pressure adjusting knob.

7. The automatic waste-liquid container system of claim 6, further comprising a tap connected to the liquid suction pipe, the tap having at least two interfaces for communication with one or more waste liquid troughs.

8. The automatic waste-liquid container system of claim 6; wherein a bottom part of the container is provided with a base; a lateral part of the base is provided with a bracket; a supporting plate is fixed on the bracket; and the pressure reducing valve is disposed on the bracket via the supporting plate.

9. The automatic waste-liquid container system of claim 6, wherein the container comprises a container body and a container cover; and the container body is connected with the container cover in a dismountable way.

10. The automatic waste-liquid container system of claim 1, further comprising a tap connected to the liquid suction pipe, the tap having at least two interfaces for communication with one or more waste liquid troughs.

11. The automatic waste-liquid container system of claim 10, wherein a bottom part of the container is provided with a base; a lateral part of the base is provided with a bracket; a supporting plate is fixed on the bracket; and the pressure reducing valve is disposed on the bracket via the supporting plate.

12. The automatic waste-liquid container system of claim 10, wherein the container comprises a container body and a container cover; and the container body is connected with the container cover in a dismountable way.

13. The automatic waste-liquid container system of claim 1, wherein a bottom part of the container is provided with a base; a lateral part of the base is provided with a bracket; a supporting plate is fixed on the bracket; and a pressure reducing valve is disposed on the bracket via the supporting plate.

14. The automatic waste-liquid container system of claim 1, wherein the container comprises a container body and a container cover; and the container body is connected with the container cover in a dismountable way.

15. The automatic waste-liquid container system of claim 14, wherein an upper surface of the container cover is provided with a non-slip film.

16. The automatic waste-liquid container system of claim 1, wherein the compressed gas flow-control assembly includes at least one of a gas flow control switch and a pressure-reducing valve.

17. The automatic waste-liquid container system of claim 1, wherein the inlet end of the exhaust pipe is connected to the container adjacent a top portion of a container body of the container.

18. The automatic waste-liquid container system of claim 17, further comprising a container cover removably connected to the top portion of the container body.

* * * * *